United States Patent [19]

Inoue et al.

[11] Patent Number: 4,753,206

[45] Date of Patent: Jun. 28, 1988

[54] FUEL INJECTION CONTROL SYSTEM FOR INTERNAL COMBUSTION ENGINE

[75] Inventors: Hidehiko Inoue; Shigenori Isomura; Toshio Kondo, all of Kariya, Japan

[73] Assignee: Nippondenso Co., Ltd., Kariya, Japan

[21] Appl. No.: 99,896

[22] Filed: Sep. 22, 1987

[30] Foreign Application Priority Data

Oct. 13, 1986 [JP] Japan ..... 61-242803

[51] Int. Cl.[4] ..... F02D 41/10

[52] U.S. Cl. ..... 123/480; 123/478

[58] Field of Search ..... 123/480, 478, 492, 493, 123/494; 364/431.07

[56] References Cited

U.S. PATENT DOCUMENTS 4,651,699 3/1987 Ohtaki et al. ..... 123/480

4,706,632 11/1987 Kasanami et al. ..... 123/480

*Primary Examiner*—Raymond A. Nelli

*Attorney, Agent, or Firm*—Cushman, Darby & Cushman

[57] ABSTRACT

In a fuel injection control system for an internal combustion engine, a basic fuel amount is determined in accordance with detected values of intake air pressure and rotational speed of the engine. The detected value of the intake air pressure is averaged by a predetermined averaging function to infer temperature of air flowing into a cylinder of the engine. The basic fuel amount is corrected by the inferred temperature, more specifically, by the difference between the detected value of the intake air pressure and the averaged value of the same so that undesired change in air-fuel ratio resulting from comparatively slow change in temperature of air flowing into engine cylinder upon acceleration and deceleration of the engine is compensated for.

9 Claims, 8 Drawing Sheets

FUEL INJECTION CONTROL SYSTEM FOR INTERNAL COMBUSTION ENGINE

BACKGROUND OF THE INVENTION

The present invention relates to a fuel injection system for an internal combustion engine which corrects fuel amount in accordance with temperature of intake air in or near engine cylinders.

It is known that a fuel injection control system is equipped with a pressure sensor for detecting an intake pressure PM in an intake pipe downstream of a throttle valve and a revolution sensor for detecting a rotational speed Ne or r.p.m. of an engine so that a basic fuel injection amount Tp may be computed according to the detected signals from the two sensors. The basic amount Tp is then corrected with an intake air temperature or the like to suppress the discrepancy of the air/fuel ratio thereby to improve the purification of engine exhaust gases. If the engine r.p.m. is constant, for example, the fuel to be fed is increased with the rise in pressure PM in the intake pipe during acceleration. On the other hand, the temperature of the air sucked into the intake pipe from an air cleaner is measured as the intake temperature for use in correcting the basic fuel amount, and the sensor for this measurement is usually disposed upstream of the throttle valve as is freed from the influences of the combustion temperture in the engine cylinder. This system cannot accurately correct the fuel amount with the intake temperature because the intake air is heated through aheat transfer from the cylinder wall of the internal combustion engine and the density of intake air is varied.

As a matter of fact, more specifically, the place which is the most liable to be thermally influenced by the running state of the engine is the cylinder, and the air having passed through the intake pipe is sucked into the cylinder through an intake valve disposed in the head of the cylinder. As a result, the temperature of air actually sucked into the cylinder will highly vary with the temperature in the cylinder.

For example, when the throttle valve is abruptly opened into an acceleration state while holding a constant r.p.m. a great amount of air is promptly sucked into the intake pipe so that the pressure in the intake air will promptly rise stepwise as shown in (a) of FIG. 13. As has been described hereinbefore, the pressure PM in the intake pipe is detected by the pressure sensor so that the basic fuel injection amount Tp is determined on the basis of the pressure value PM at this time and the engine revolution number Ne. At the same time, the fuel is increased in conformity to the pressure variations in the intake pipe while compensating the fuel wetting the intake port so that a constant air/fuel ratio may be maintained at all times.

In the acceleration state of (a) of FIG. 13, however, the temperature in the intake pipe has its temperature rather dropped by the flow of the increased intake air, as seen from (b) of FIG. 13, but the air in the vicinity of the cylinder is gradually heated to a high temperature by the intensive combustion in the cylinder. In case, on the other hand, the high load run at this time is abruptly released, the flow velocity in the intake pipe restores its initial value, and the temperature in the intake pipe rises to its initial level. On the other hand, the rising rate of the air temperature in the cylinder during the acceleration is far slower than that of the pressure in the intake pipe, which instantly responds to the motion of the throttle valve. The falling rate of the air temperature in the cylinder during deceleration is also far slower than that of the pressure in the intake pipe. This is because it takes a considerable time for the cylinder itself to be heated or cooled in accordance with the intensity of the combustion state in the cylinder. As has been described above, the variations in the air temperature at the cylinder shown in (b) of FIG. 13 are slower than those in the pressure in the intake pipe shown in (a) of FIG. 13.

A stoichiometric air/fuel ratio is obtained, as shown in (c) of FIG. 13, while a high load run continues so that the air temperature in the cylinder is stable. When the air temperature in the cylinder is in its rising course, the air temperature in the cylinder is still low to give a high air density, that is, an excessive air to the fuel which is set in accordance with the pressure in the intake pipe so that the air/fuel ratio is shifted for several tens seconds to the lean side. At the end of the deceleration, on the contrary, the air temperature in the cylinder is still high, although the throttle valve is returned to allow the pressure in the intake pipe to restore its initial value so that the fuel flow rate is dropped. As a result, the air density is still low to give a smaller air flow rate to the fuel so that the air/fuel ratio is shifted for several tens seconds to the rich side. These shifts of the air/fuel ratio will invite deterioration in the exhaust gas emission.

There is also known a technique of compensating the fuel amount while inferring the temperature of intake air flowing in the intake pipe, as is disclosed in Japanese Patent Laid-Open No. 60-90933. In this fuel rate correction by the intake air temperature of Japanese Patent Laid-Open No. 60-90933, too, the injection rate of the fuel is determined while leaving it impossible to compensate for the density variations due to the temperature variations of air.

In order to eliminate this problem, moreover, it is conceivable to measure the air temperature in the cylinder directly by attaching a temperature sensor to the cylinder wall. It is remarkably difficult to realize a temperature sensor which sensitively responds to the various running conditions of the engine while retaining sufficient durability.

It is therefore an object of the present invention to provide a fuel injection system which accurately control the air/fuel ratio no matter what the running state is, by considering the intake air temperature in or near the engine cylinder.

DETAILED DESCRIPTION OF THE PREFERRED EMBODIMENT

Figure 1:
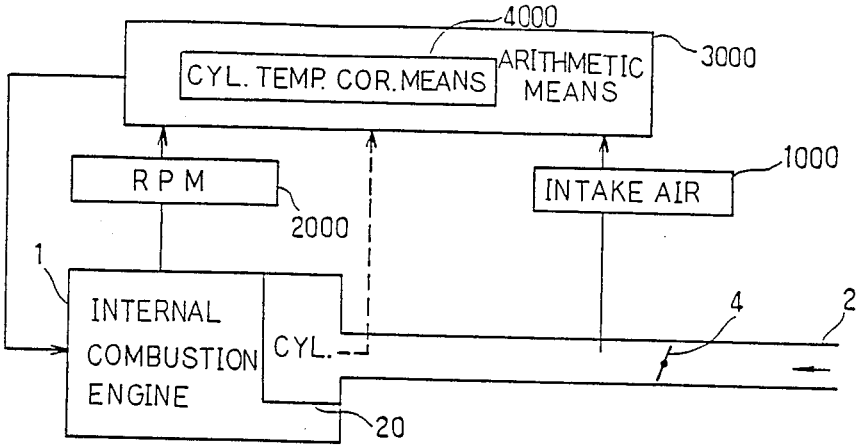
FIG. 1 is a schematic diagram showing the general concept of the present invention.

General concept of the present invention is described first with reference to FIG. 1.

A fuel injection system according to the present invention is provided with intake air detecting means 1000 for detecting intake air in an intake pipe 2 having a throttle valve 4, revolution (r.p.m.) detecting means 2000 for detecting the number of revolutions of an internal combustion engine 1 having a cylinder 20, arithmetic means 3000 for computing the amount of a fuel to be fed to the internal combustion engine 1 in accordance with the respective signals detected by the revolution detecting means 2000 and the intake air detecting means 1000. The arithmetic means 3000 includes cylinder intake temperature correcting means 4000 for correcting the basic fuel amount in accordance with intake air density represented by the air temperature in the cylinder 20 of the internal combustion engine 1.

With this structure, even if the intake air to be sucked through the intake pipe 2 into the cylinder 20 is subjected to density variations by the thermal influences from the cylinder 20 which will be subjected to temperature variations in accordance with the running condition of the internal combustion engine 1, the fuel injection amount can be corrected to a value from which those density variations are compensated by the cylinder intake air temperature correcting means 4000. In other words, the fuel injection amount is corrected in accordance with the temperature state of air immediately before the combustion so that the fuel is always fed at a rate suited for the running state of the internal combustion engine 1 to optimize the air/fuel ratio.

Figure 2:
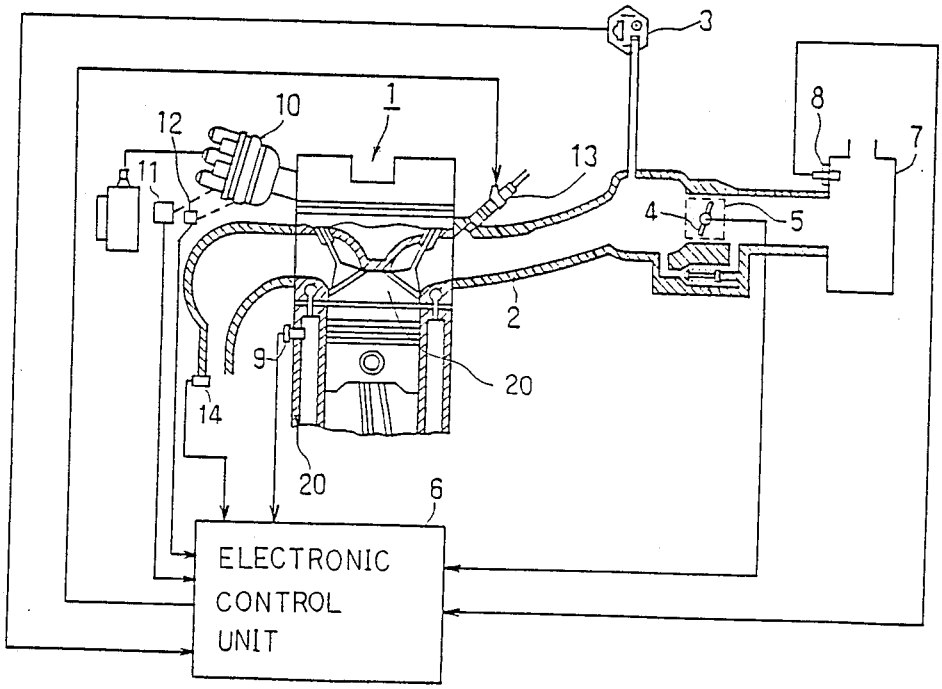
FIG. 2 is a schematic view showing the whole structure of the internal combustion engine according to the present invention.

FIG. 2 is a view showing the overall structure of a fuel injection control system for an internal combustion engine, to which is applied the present invention.

Reference numeral 1 denotes the internal combustion engine, to which is connected an intake pipe 2 which in turn is equipped midway thereof with the throttle valve 4 to be turned in accordance with the accelerating operation of a driver and a pressure sensor 3 used as intake air detecting means 1000 for detecting the pressure of air downstream of the throttle valve 4. The throttle valve 4 is equipped with a throttle position sensor 5 for converting the opening degree of the throttle valve 4 into an electric signal to feed it to an electronic control unit (which will be shortly referred to as "ECU") used as arithmetic means 3000 for computing the fuel injection amount. At the entrance of the intake pipe 2 upstream of the throttle valve 4, there is disposed an air cleaner 7, to which is attached an intake air temperature sensor 8. This intake air temperature sensor 8 produces an electric signal correlated with the temperature of the air sucked through the air cleaner 7. This signal detected by the temperature sensor 8 is also inputted to the ECU 6. The cylinder 20 of the internal combustion engine 1 is equipped in its outer wall with a water temperature sensor 9 for detecting the temperature of cooling water to feed its detected value to the ECU 6. On the camshaft of the internal combustion engine 1, there is mounted a distributor 10, to which in turn are attached a revolution angle sensor 11 and a crank angle sensor 12 used as revolution detecting means 2000 for detecting the number of revolutions Ne of the engine 1. The former and latter sensors 11 and 12 output pulses at respectively predetermined crank angle positions of every 30 degrees and 180 degrees, respectively. These pulses are also inputted to the ECU 6. Denoted at numeral 14 is an oxygen concentration sensor which is disposed in an exhaust pipe for detecting the oxygen concentration in the engine exhaust gases to input its detected signal to the ECU 6. In the intake pipe 2 between the internal combustion engine 1 and the throttle valve 4, there are provided for the engine cylinders, respectively, injecotrs 13 each of which is electrically controlled by the ECU 6 in the known manner. These injectors have their drive time TAU controlled by the injection signal which is computed by the ECU 6 from the detected signals of the aforementioned individual sensors.

The drive time TAU of the injector 13 is computed from the following formula (1).

$$TAU = Tp \times FCTHA \times FTCX + TAUV \quad (1)$$

Here, Tp designates a basic fuel injection amount which is determined through a map retrievable from the pressure PM and revolution number Ne determined by the pressure sensor 3, the revolution angle sensor 11 and the crank angle sensor 12. FCTHA designates an air density correction value for correcting the basic injection amount Tp in accordance with the density of the intake air at the cylinder. The computation step of this air density correction value FCTHA will be described in detail hereinafter. FTCX designates an injection correction value other than FCTHA, which is computed from the outputs of the aforementioned various sensors such as the throttle position sensor 5, the intake temperature sensor 8, the oxygen concentration sensor 14 in accordance with the state and running condition of the internal combustion engine. Moreover, TAUV designates a correction value for compensating the response time delay in the opening of the injectors 13, and the correction value TAUV is determined from a table retrieval based on the battery voltage. The above-specified correction values FCTHA, TRCX and TAUV and the final fuel injection amount TAU are computed by the ECU 6 as described below.

Figure 3:
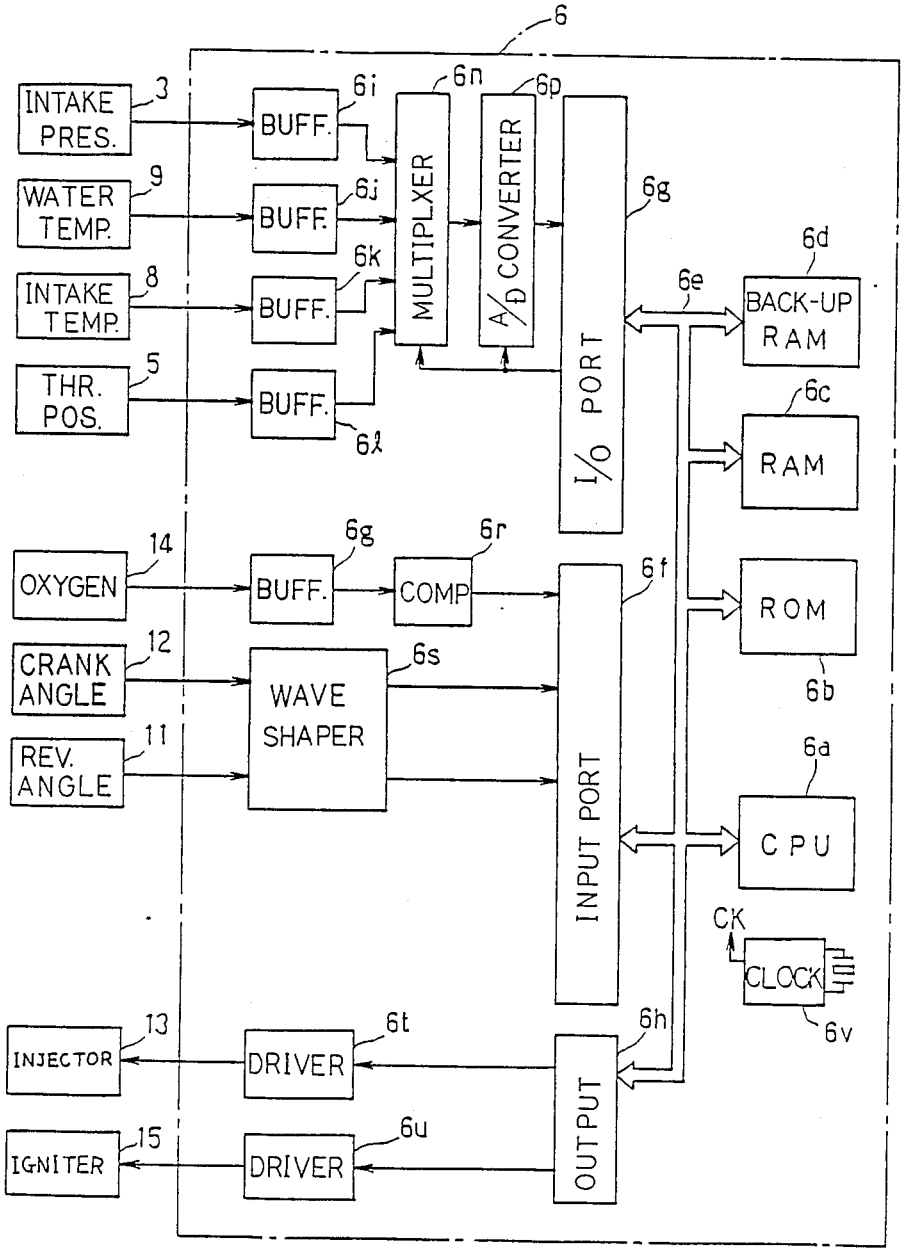
FIG. 3 is a block diagram showing the internal structure of the electronic control circuit 6 of FIG. 2.

FIG. 3 shows the internal structure of the ECU 6 of FIG. 2.

The ECU 6 is equipped with: a CPU 6*a* for receiving and computing the individual signals detected by the aforementioned sensors in accordance with a control program and for performing processings to control the aforementioned devices; a ROM 6*b* for storing aforementioned program and initial data stored in advance; a RAM 6*c* for temporarily storing a variety of signals to be inputted to the ECU 6 and data necessary for the arithmetic controls; and a backup RAM 6*d* continuously backed up by a battery to store and hold a variety of data necessary for the subsequent control of the internal combustion engine 1 even after the key switch of the engine 1 has been turned off. These components of the ECU 6 are connected through a common bus 6*e* with an input port 6*f*, an input/output port 6*g* and an output port 6*h*. They may send the inputs to and receive the outputs of the external devices.

More specifically, the ECU 6 is equipped therein with buffers *6i, 6j, 6k* and *6l* for the output signals from the aforementioned intake pipe pressure sensor 3, water temperature sensor 9, intake temperature sensor 8 and throttle position sensor 5, respectively. There are also arranged a multiplexer *6n* for selectively outputting the output signals from the aforementioned individual sensors to an A/D converter *6p* for converting analog signals into respective digital signals. These individual signals are inputted through the input/output port *6g* to the CPU *6a*. The ECU 6 is further equipped with a buffer *6q* for the output signal of the oxygen concentration sensor 14, a comparator *6r* for outputting a signal in case the output voltage of said buffer *6q* exceeds a predetermined voltage corresponding to the stoichiometric air/fuel ratio, and a waveform shaping circuit *6s* for shaping the waveforms of the output signals of both the crank angle sensor 12 and the revolution angle sensor 11. These individual signals are inputted through the input port *6f* to the CPU *6a*. The CPU is further equipped with drivers *6t* and *6u* for supplying drive currents to the aforementioned injectors 13 and igniters 15 which are not shown in FIG. 2. The CPU *6a* outputs the control signal through the output port *6h* to both the aforementioned drivers *6t* and *6u*. The ECU 6 is further equipped with a clock circuit *6v* for sending a clock signal CK for providing a control timing at a predetermined interval to the CPU *6a* and so on.

Next, the procedures to be executed for computing the fuel injection amount TAU of a fuel in accordance with the density of the air to be sucked into the cylinder will be orderly described in detail in the following.

Figure 4:
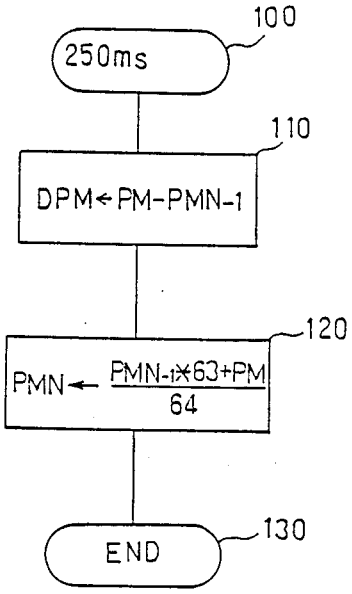
FIGS. 4 and 5 are flow charts showing a first embodiment of the correcting procedures of the fuel injection amount with the cylinder air temperature.
Figure 5:
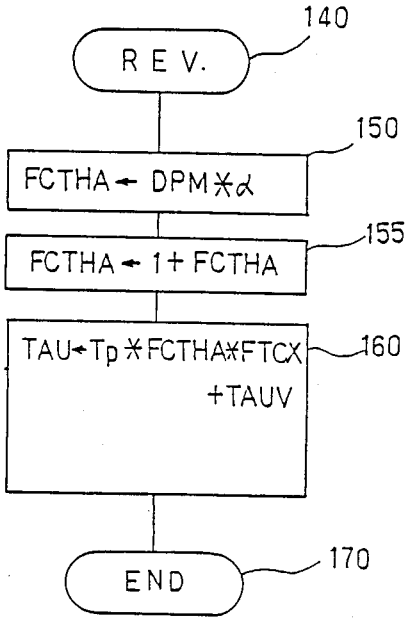
Figure 13:
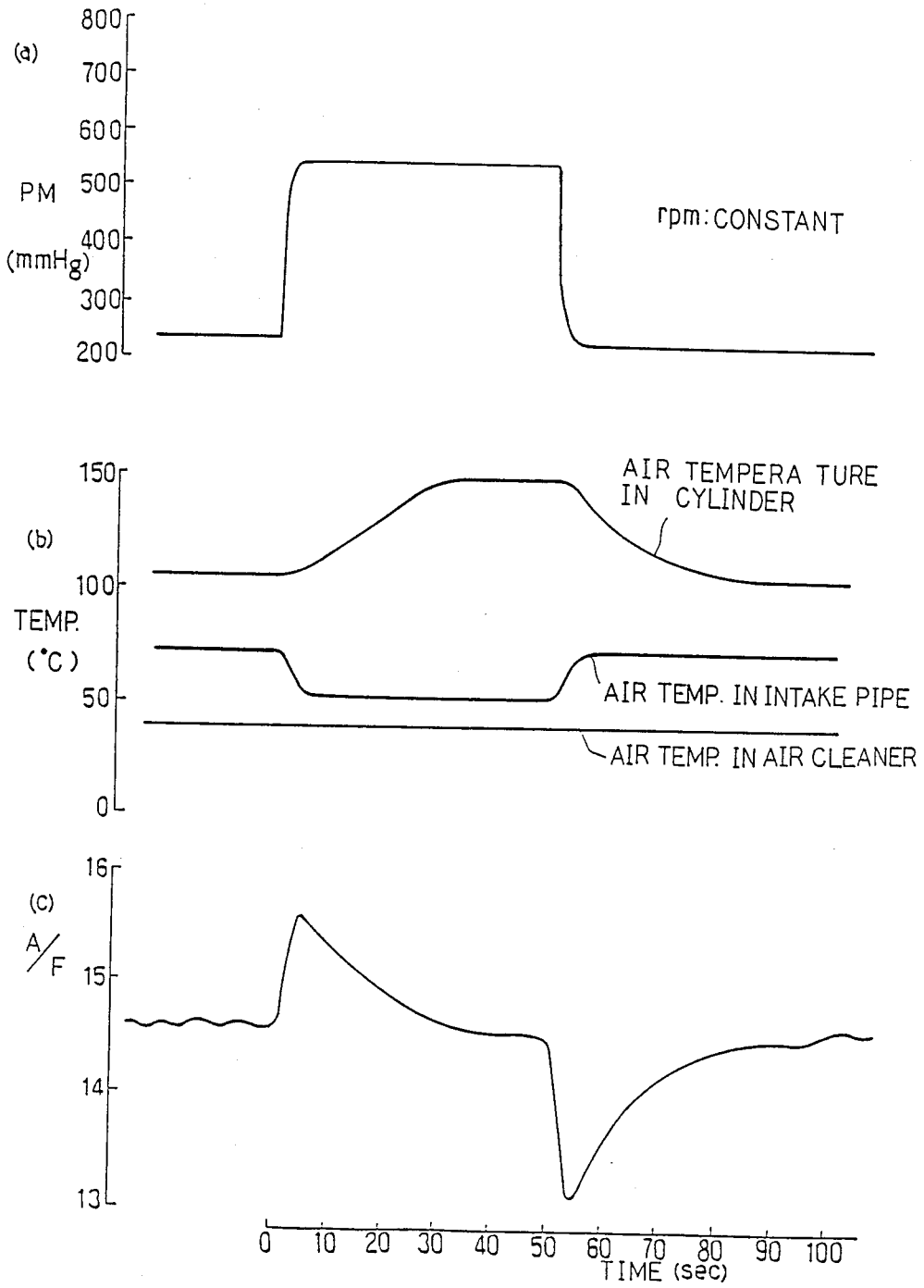
FIG. 13 is a graph depicting the characteristics of the system of the prior art.

FIGS. 4 and 5 show the procedures for inferring the air temperature in or near the cylinder as shown in (b) of FIG. 13, on the basis of the intake air pressure signal PM from the pressure sensor 3, in case the pressure signal PM changes as shown in (a) of FIG. 13, and for computing the fuel injection amount.

In FIG. 4, there is shown a routine 100, in which an averaged or smoothed pressure value PMN substantially corresponding to the air temperature in the cylinder 20 is computed at the every 250 ms. At a first step 110, a value DPM is determined by subtracting a previous average pressure value $PMN_{-1}$ from the presently detected pressure value PM. The value DPM corresponds to the discrepancy between the pressure waveform of (a) of FIG. 13 and the waveform of the cylinder intake air temperature of (b) of FIG. 13. At a step 120, the present pressure value PM is averaged by the previous averaged pressure value $PMN_{-1}$ is determined from the formula of $(PM_{-1}\times 63+PM)/64$. Though this averaging function is determined experimentally, it is confirmed that a time delay of about 40 seconds or so in which PMN reaches PM presents good result. The present routine is ended at a step 130.

FIG. 5 shows a routine 140 in which the final fuel injection amount TAU is computed from a specified crank angle at each revolution of the engine. At a step 150, the air density correction value FCTHA is determined by multiplying the value DPM determined in the preceding routine 100 by a predetermined fundamental correction value $\alpha$ (e.g., $\alpha=0.04$ in the case of the internal combustion engine used in the embodiment). Here, this value FCTHA becomes positive during acceleration because the value DPM is positive, becomes negative during deceleration because the value DPM is negative, and become 0 when the value DPM is at 0. At a subsequent step 155, the value FCTHA is incremented by 1, and the routine proceeds to a subsequent step 160, at which the final fuel injection amount TAU is determined from the foregoing formula (1) and the present routine is ended at a step 170. Incidentally, the incrementation of the value FCTHA by 1 at the foregoing step 155 is conducted because the injection rate is corrected by multiplying the value Tp by the value FCTHA at the subsequent step 160. No correction of the basic fuel injection amount is performed if FCTHA=1. Then, a signal having an injection pulse width according to the final injection amount TAU is fed from the ECU 6 to the injector 13 so that the fuel is injected into the internal combustion engine 1.

Figure 6:
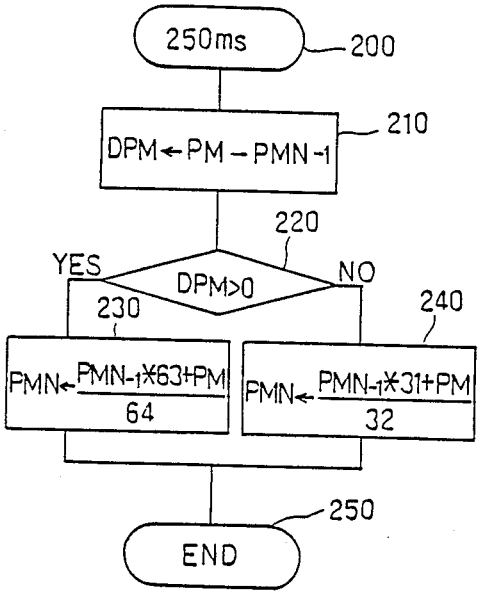
FIGS. 6 and 7 are flow charts showing a second embodiment of the correcting procedures.
Figure 7:
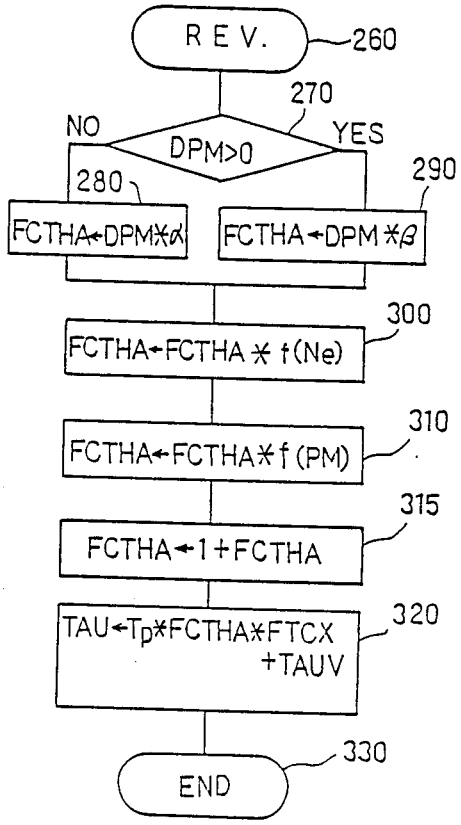

FIGS. 6 and 7 show the other embodiment which is alternative to the embodiment of FIGS. 4 and 5. The routine of FIG. 6 is started at every 250 ms at a step 200. At a step 210, the difference value of $PM-PMN_{-1}$ is used as the value DPM like the foregoing step 110, and the routine proceeds to a step 220. At this step 220, it is judged in view of the positive or negative signs of the value DPM whether the running state is in acceleration or deceleration, by making use of the fact that the rise and fall of the averaged value $PMN_{-1}$ are delayed from those of the actual pressure value PM. For $DPM\leqq 0$ representing a normal running or deceleration state in which the intake pressure is unchanged or drops, the routine proceeds to a step 240. For $DPM>0$ representing acceleration, on the contrary, the routine proceeds to a step 230. At the step 230, the present averaged pressure value PMN is determined from $(PMN_{-1}\times 63+PM)/64$. At the step 240, the value PMN is determined from $(PMN_{-1}\times 31+PM)/32$, and the present routine is ended at a step 250. Thus, the engine in which the temperature rising and dropping rates of the cylinder 20 are different can be coped with by providing the different averaging formulas at the steps 230 and 240.

Next, the routine of FIG. 7 is started at a step, and the deceleration state is checked again at a step 270 in view of the positive or negative sign of the DPM. If $DPM\leqq 0$, the state is steady or in deceleration, and the routine proceeds to a subsequent step 280, at which the air density correction value FCTHA is obtained from $DPM\times\alpha$. If in the acceleration state, the value FCTHA is obtained at a step 290 from $DPM\times\beta$. Here, $\alpha$ and $\beta$ are different fundamental correction values which are set $\alpha=0.04$ and $\beta=0.03$ in the case of the characteristics of the internal combustion engine 1 used in the embodiment. Thus, the air density correction value FCTHA can be selected in accordance with the acceleration or deceleration so that the injection rate characteristics required by the engine 1 can be more approached.

Figure 8:
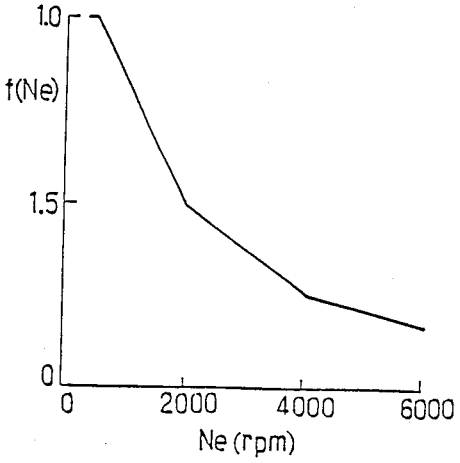
FIG. 8 is a graph for determining the correction factor f(Ne) from the revolution number Ne at the step 300 of FIG. 7.

At a subsequent step 300, the value FCTHA is corrected in accordance with the engine revolution number Ne detected by the revolution angle sensor 11. Here, the graph depicted in FIG. 8 is used to retrieve the revolution number correction factor f(Ne) from the revolution number Ne, and the value FCTHA multiplied by the value f(Ne) substitutes the value FCTHA. Owing to this step 300, even if the value DPM determined at the step 240 is equal, it is possible to meet a requirement that a fuel increase necessary for a high r.p.m. at this time is not so much.

Figure 9:
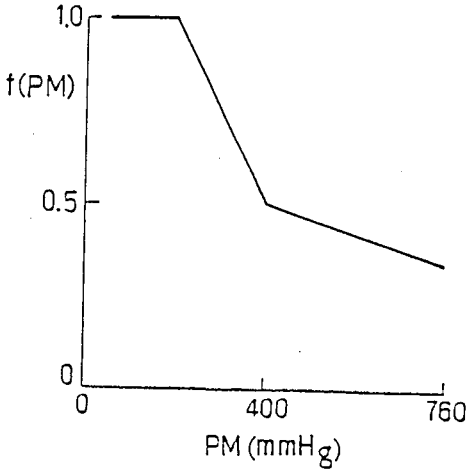
FIG. 9 is a graph for determining the correction factor f(PM) from the pressure value PM at the step 310 of FIG. 7.

At a step 310, this new value FCTHA is further corrected with the intake air pressure PM. An intake pressure correction factor f(PM) is table-retrieved from the intake air pressure value PM as depicted in FIG. 9.

Owing to this step 310, the increase in the fuel injection amount can be suppressed if the intake air pressure is intrinsically high, for example. The value FCTHA is multiplied by the factor f(PM) to correct the value FCTHA into a renewed value FCTHA. This value FCTHA is used to determine the final injection amount TAU by the foregoing formula (1) and then the present routine is ended at a step 330.

At the aforementioned steps 300 and 310, the air/fuel ratio can be controlled more proerly by making a correction such that the air density correction value FCTHA is made smaller with the intake pipe pressure PM and the engine revolution number Ne for the higher load and revolution.

Figure 10:
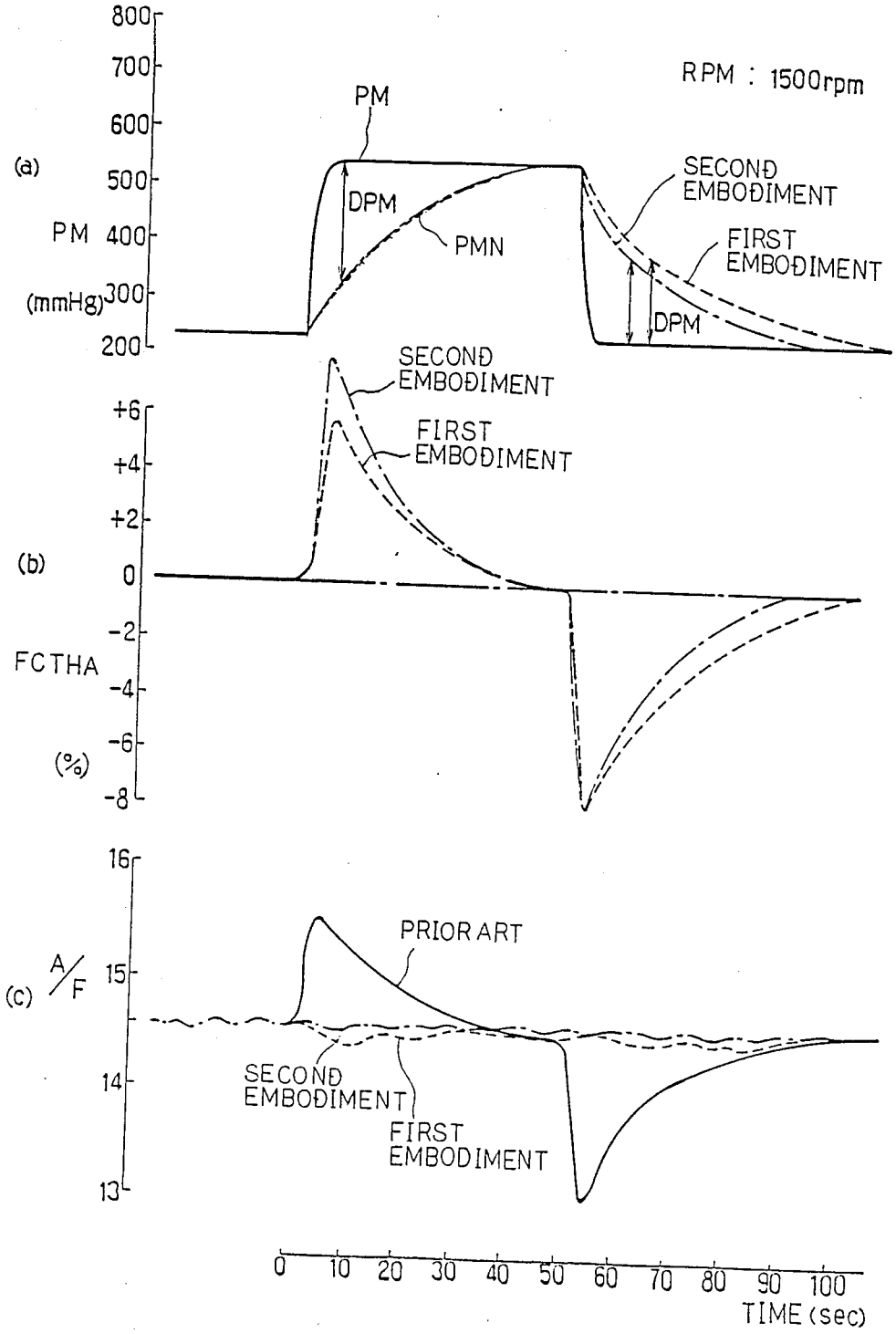
FIGS. 10 to 12 are graphs depicting the results of the embodiment of the present invention.

In the experiments conducted, the pressure in the intake pipe was changed, as indicated by a solid curve in (a) of FIG. 10, by effecting an acceleration and a deceleration while holding the revolution number Ne at 1,500 r.p.m. The averaged pressure value PMN is computed, as indicated by a broken curve, in the foregoing first embodiment shown in FIGS. 4 and 5 and, as indicated by a single-dotted line, in the foregoing second embodiment shown in FIGS. 6 and 7. The averaging formula of the step 240 in the second embodiment for the deceleration is more highly reflected by the actual pressure value PM than that of the step 230. Therefore, the averaged pressure value PMN of the second embodiment is converged earlier into the actual pressure value PM after the deceleration that that of the first embodiment in which the pressure values PM during both the acceleration and deceleration are averaged at the step 120 using the same arithmetic formula as that of the step 230.

Moreover, the averaging formula of the steps 120, 230 and 240 are so determined that the change rate of the value PMN of (a) of FIG. 10 may become as close as possible in both the first and second embodiments to the actual change rate in the cylinder intake air temperature depicted in (b) of FIG. 13 in conformity to the characteristics of the internal combustion engine.

In (a) of FIG. 10, the difference between the actual pressure value PM and the averaged pressure value PMN corresponds to the value DPM, which is expressed by: $DPM>0$ for acceleration; $DPM<0$ for deceleration; and $DPM=0$ for stable state, as has been described hereinbefore. The aforementioned air density correction value FCTHA is determined at the steps 155 and 315, and the final injection rate $TAU=Tp\times FCTHA\times FTCX+TAUV$ is computed by the use of the foregoing formula (1) at the steps 160 and 320. In view of (b) of FIG. 10 indicating how much the final injection amount TAU is increased or decreased in comparison with the injection rate of the prior art, the value is increased for the acceleration and decreased for the deceleration in accordance with the value DPM both in the first and second embodiments. As has been described hereinbefore, the changes in the value PMN are set equal to those in the intake air temperature in the cylinder. For $PMN<PM$, the air in the cylinder has a low temperature and a high air density so that the amount of fuel is accordingly increased. For $PMN>PM$, on the contrary, the air density in the cylinder is low so that the amount of fuel is decreased.

Thus, the undesired phenomenon of the prior art that the air/fuel ratio is increased or leaned for the acceleration and decreased or enriched for the deceleration is eliminated, as shown in (c) of FIG. 10, and a stable air/fuel ratio can be attained even with the variations of the running state in accordance with both the first and second embodiments.

Here, the second embodiment can realize an air/fuel ratio superior to that of the first embodiment because it employs the correction of the value FCTHA with the revolution number Ne and the pressure PM in addition to the correction of the first embodiment and changes the methods of computing the values PMN and DPM for the acceleration and deceleration.

Figure 11:
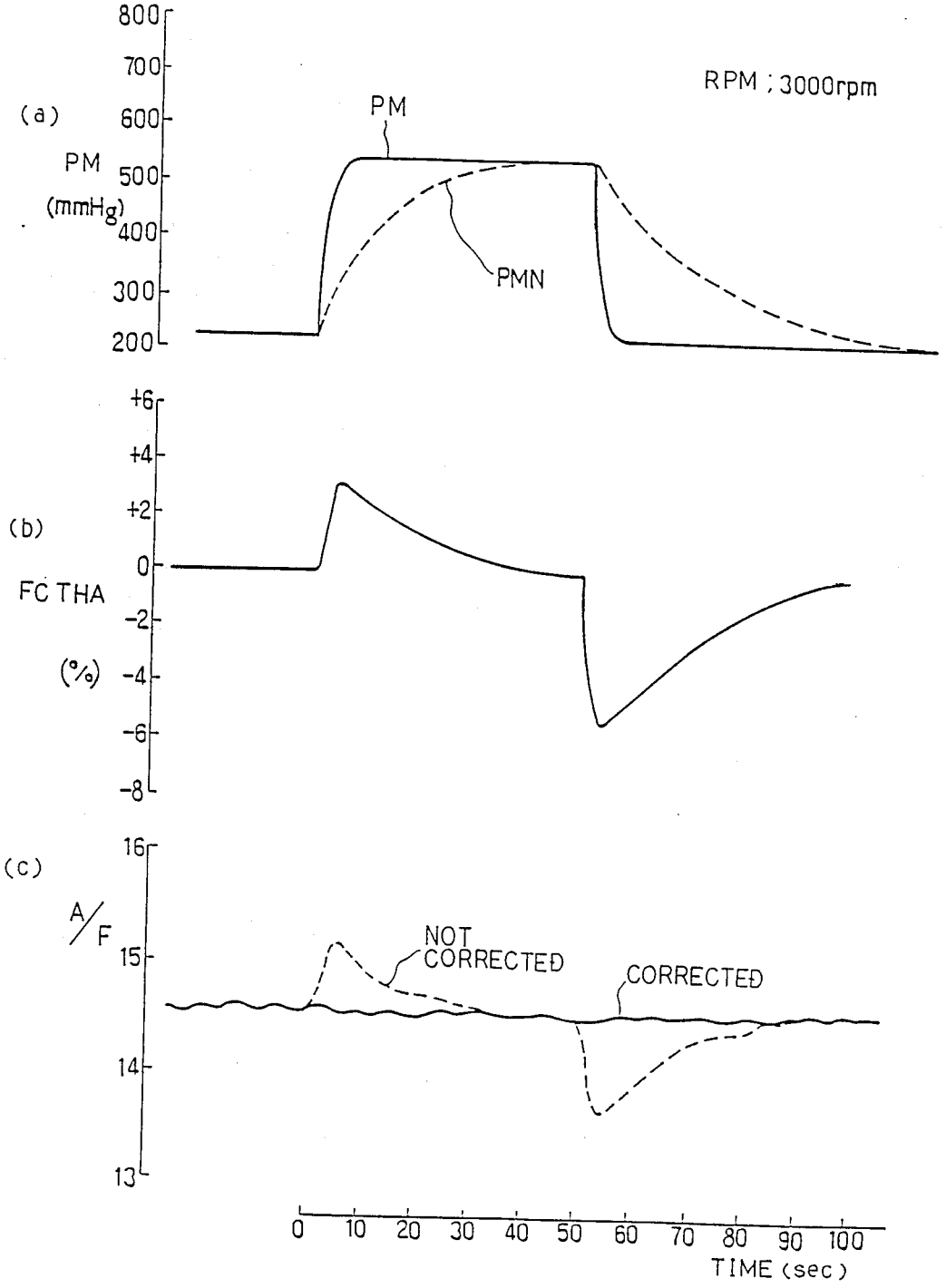
Figure 12:
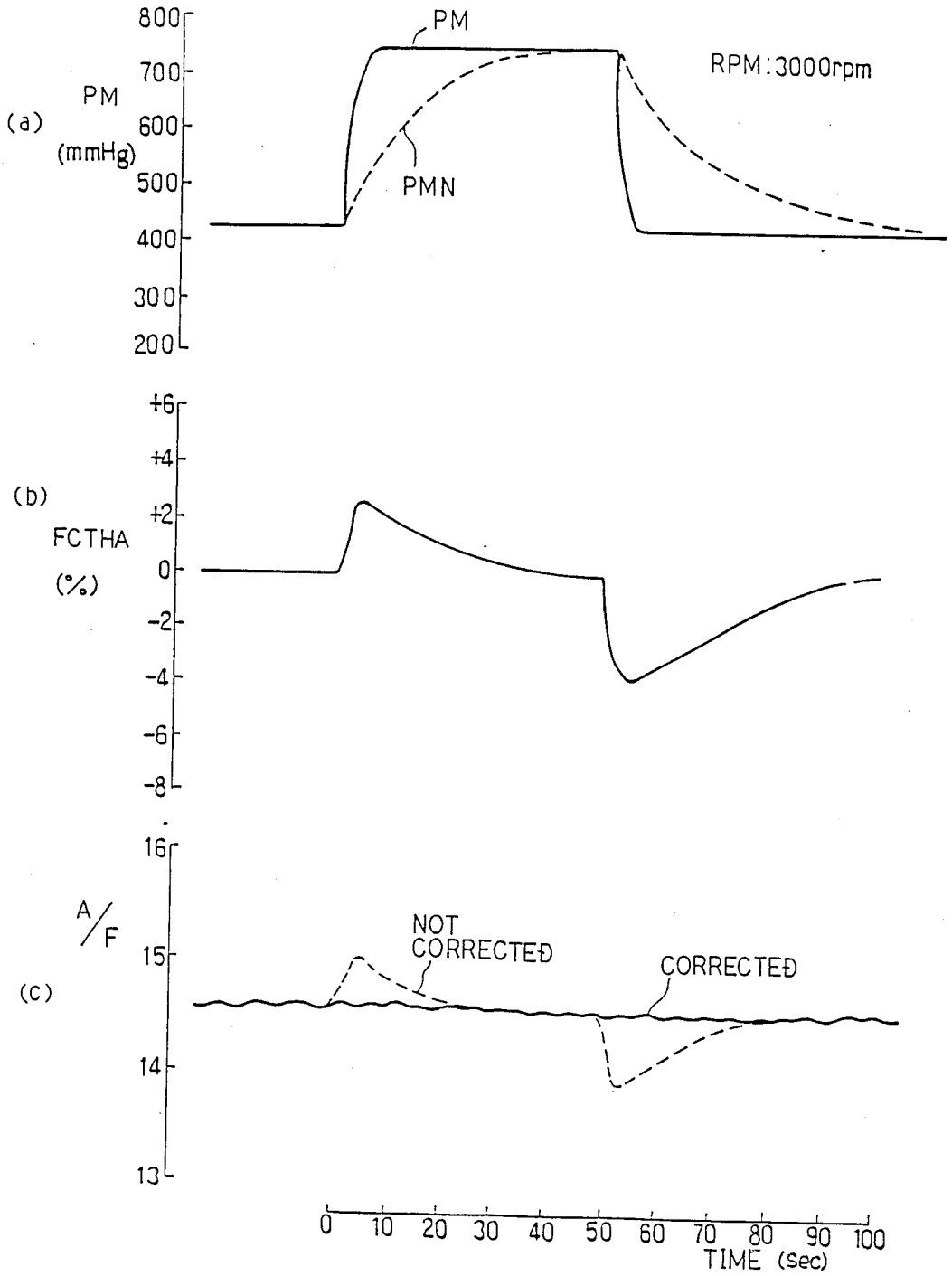

FIG. 11 presents the control result of the first embodiment in case intake pressure is changed between 220 mmHg and 550 mmHg maintaining the revolution number $Ne=3{,}000$ r.p.m., and FIG. 12 presents the control result in which the intake pressure PM in the intake pipe 2 is changed between 420 mmHg and 750 mmHg with $Ne=3{,}000$ r.p.m. In both of these results, the fluctuations of the air/fuel ratio can be accurately suppressed.

In the first and second embodiments thus far described, the final fuel injection amount TAU is computed by the following formula (1):

$$TAU\leftarrow Tp\times FCTHA\times FTCX+TAUV \quad (1).$$

Despite of this fact, however, the step 155 in FIG. 5 or the step 315 in FIG. 7 may be omitted so that the final fuel injection amount TAU may be computed by adding the value FCTHA determined at the previous step 150 or 310 as it is to the value Tp. For example, the final fuel injection amount TAU may be calculated from the following formula (2):

$$TAU\leftarrow Tp\times FTCX+FCTHA+TAUV \quad (2).$$

The selection of these formulas (1) and (2) is determined so that a proper fuel injection amount any prevail in the whole drive range in response to the individual requirement characteristics of the internal combustion engine. It is quite natural that the formulas (e.g., (1) or (2)) reflecting the value FCTHA on the basic injection amount Tp may be selected for various uses in accordance with the running state of the engine.

With structure thus far described, the changes in the air density due to the heat in the cylinder 20, as shown in FIG. 13, can be compensated by averaging the pressure value in the intake pipe 2 without may use of an expensive sensor for directly detecting the temperature of the cylinder of the internal combustion engine 1. This can solve the problem that the fuel to be fed to the internal combustion engine is so lean as to increase the air/fuel ratio because the air has a low temperature and a high air density during acceleration until the cylinder is warmed up whereas the fuel to be fed is so richer than necessary as to decrease the air/fuel ratio because the air is heated and expanded to have a low air density by the residual heat in the cylinder even after a high load run is ended.

The present invention having been described with reference to preferred embodiments should not be limited but may be modified, for example, to detect intake air by way of opening degree of the throttle valve.

What is claimed is:

1. A fuel injection control system for an internal combustion engine comprising:

intake air detecting means for detecting intake air amount flowing through an intake passage of said engine;

speed detecting means for detecting a rotational speed of said engine;

fuel supplying means for supplying said engine with fuel; and electronic control means for controlling amount of fuel to be supplied by said fuel supplying means in accordance with the detected intake air amount and the detected rotational speed said electronic control means including:

first means for determining a basic fuel amount in accordance with the detected intake air amount and the detected rotational speed;

second means for averaging the detected intake air amount based on an averaging function predetermined to infer temperature of intake air flowing into a cylinder of said engine;

third means for determining a correction value as a function of the averaged intake air amount; and fourth means for correcting the basic fuel amount by the correction value so that said fuel supplying means supplies said engine with fuel by an amount proportional to the corrected fuel amount.

2. A fuel injection control system according to claim 1, wherein said electronic control means further includes fifth means for deriving a difference between the detected intake air amount and the averaged intake air amount, and wherein said third means determines the correction value in accordance with the difference.

3. A fuel injection control system according to claim 2, wherein said electronic control means further includes sixth means for discriminating acceleration and deceleration of said engine, and wherein said second means changes the predetermined averaging function in response to the discrimination result of said sixth means so that the averaged intake air amount follows the detected intake air amount faster upon deceleration of said engine than upon acceleration of said engine.

4. A fuel injection control system according to claim 1, wherein said electronic control means further includes seventh means for correcting the correction value in accordance with the detected intake air amount and the detected rotational speed.

5. A fuel injection control system according to claim 1, wherein said intake air detecting means includes a pressure detector positioned downstream a throttle valve of said engine.

6. A fuel injection control system for an internal combustion engine comprising:

intake air pressure detecting means for detecting intake air pressure in an intake passage of said engine;

speed detecting means for detecting a rotational speed of said engine;

fuel supplying means for supplying said engine with fuel; and electronic control means for controlling amount of fuel supplied by said fuel supplying means in accordance with the detected intake air pressure and the detected rotational speed, said electronic control means being programmed to;

(a) determine a basic amount of fuel in accordance with the detected intake air pressure and the detected rotational speed, (b) average the detected intake air pressure based on an averaging function predetermined to infer temperature of intake air flowing into a cylinder of said engine, (c) determine a correction in relation to the averaged intake air pressure, and (d) correct the determined basic amount of fuel by the determined correction value so that said fuel supplying means supplies said engine with fuel by an amount proportional to the corrected basic amount of fuel.

7. A fuel injection control system according to claim 6, wherein said electronic control means is further programmed to; (e) derive difference between the detected intake air pressure and the averaged intake air pressure, and wherein said correction value is determined in accordance with the derived pressure difference in such a manner that the correction value is increased as the derived pressure difference is increased.

8. A fuel injection control system according to claim 7, wherein said electronic control means is further programmed to;

(f) discriminate acceleration and deceleration of said engine from the polarity of the derived pressure difference, and (g) change the predetermined averaging function in response to the discrimination result so that the averaged intake air pressure follows the detected intake air pressure faster upon deceleration of said engine than upon acceleration of said engine.

9. A fuel injection control system according to claim 8, wherein said electronic control means is further programmed to;

(h) decrease the correction value in accordance with increase in the detected intake air pressure and the detected rotational speed.

* * * * *